US008480140B2

(12) United States Patent
Zhang

(10) Patent No.: US 8,480,140 B2
(45) Date of Patent: Jul. 9, 2013

(54) SEALING FASTENER

(75) Inventor: Lei Zhang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 269 days.

(21) Appl. No.: 13/014,733

(22) Filed: Jan. 27, 2011

(65) Prior Publication Data

US 2012/0141228 A1 Jun. 7, 2012

(30) Foreign Application Priority Data

Dec. 1, 2010 (CN) ..... 2010 1 0568563

(51) Int. Cl.
*B65D 27/30* (2006.01)
*B65D 63/00* (2006.01)

(52) U.S. Cl.
USPC ..... 292/317; 24/16 PB

(58) Field of Classification Search
CPC ..... E05B 65/006; G09F 3/0317; G09F 3/037; G09F 17/00; B65D 63/1072
USPC ..... 292/1, 307 R, 317–321, 326, 307 A, 292/307 B; 24/16 PB, 17 AP
See application file for complete search history.

(56) References Cited

U.S. PATENT DOCUMENTS

| | | | | |
|---|---|---|---|---|
| 3,462,802 | A * | 8/1969 | Merser | 24/16 PB |
| 3,830,538 | A * | 8/1974 | Moberg | 292/322 |
| 4,082,336 | A * | 4/1978 | Natkins | 292/318 |
| 4,537,432 | A * | 8/1985 | Meeks | 292/318 |
| 4,833,807 | A * | 5/1989 | McLean | 40/633 |
| 5,056,837 | A * | 10/1991 | Fuehrer | 292/307 R |
| 5,123,686 | A * | 6/1992 | Wenk | 292/321 |
| 5,568,952 | A * | 10/1996 | Ruegg | 292/318 |
| 6,174,006 | B1 * | 1/2001 | Burt | 292/307 A |
| 6,343,819 | B1 * | 2/2002 | Shiozaki | 292/307 R |

* cited by examiner

*Primary Examiner* — Carlos Lugo
*Assistant Examiner* — Nathan Cumar
(74) *Attorney, Agent, or Firm* — Altis Law Group, Inc.

(57) ABSTRACT

A plastic sealing fastener includes a fixing member, a locking member defining a locking slot, a latching strip formed on the fixing member and a cover fixed on the fixing member. The locking member forms a locking portion in the locking slot. The cover defines a covering hole communicating with the locking slot, and a size of the covering hole is less than that of the locking slot. The locking portion comprises, for example, three locking teeth.

6 Claims, 3 Drawing Sheets

SEALING FASTENER

CROSS-REFERENCE TO RELATED APPLICATIONS

This application is related to two co-pending U.S. patent applications which are application Ser. No. 13/014,732 and 13/014,731, and entitled "SEALING FASTENER". In the co-pending applications, the inventor is LEI ZHANG. The co-pending application have the same assignee as the present application. The disclosure of the above identified application is incorporated herein by reference.

BACKGROUND

1. Technical Field

The present disclosure relates generally to security, and especially to a plastic sealing fastener for securing closures.

2. Description of Related Art

A commonly used plastic sealing fastener includes a fixing member and a latching strip thereon. The fixing member defines a locking hole. The latching strip is fixed in the locking hole for securing a closure. However, the plastic sealing fastener is easily unlocked by moving the latching strip using an ordinary tool such as a metal strip.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
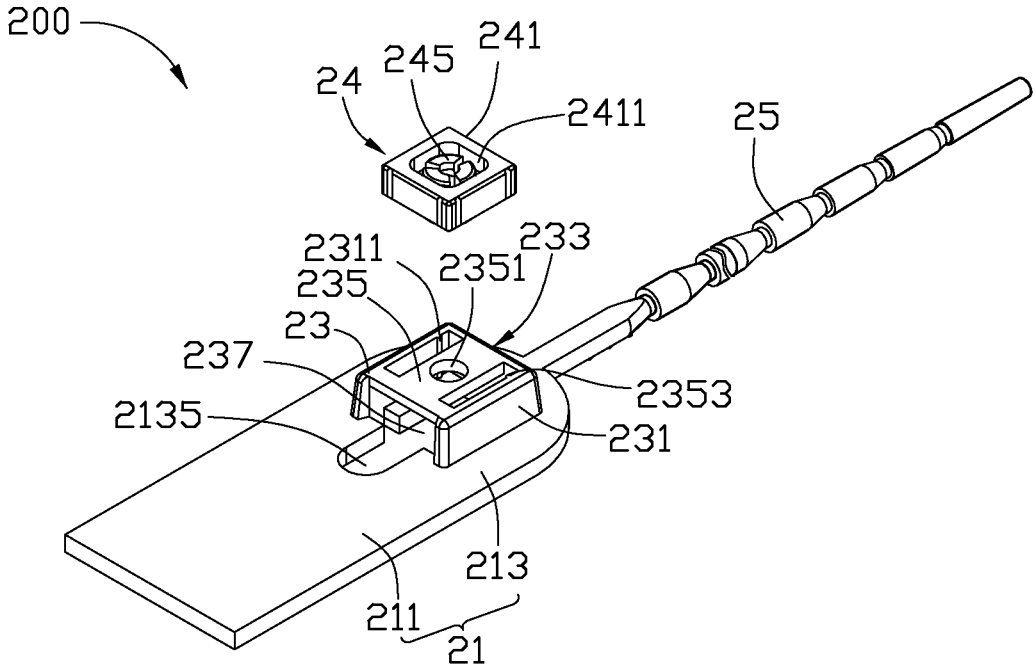
FIG. 1 is an exploded, isometric view of an embodiment of a plastic sealing fastener including a fixing member and a locking member.
Figure 2:
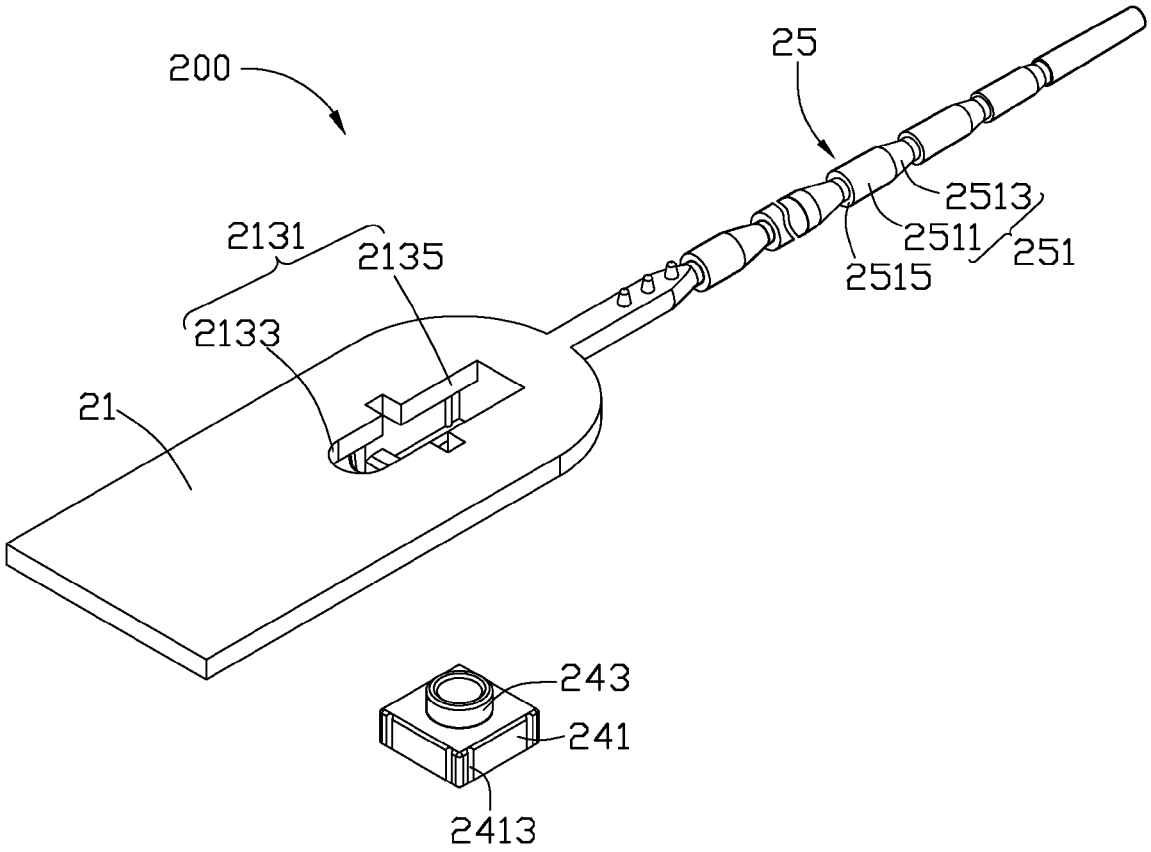
FIG. 2 is similar to FIG. 1, but viewed from another aspect.

Referring to FIGS. 1 and 2, an embodiment of a plastic sealing fastener 200 includes a substantially rectangular fixing member 21, a cover 23 positioned on a surface of the fixing member 21, a locking member 24 and a latching strip 25. The latching strip 25 is formed at an end of the fixing member 21.

The fixing member 21 includes a labeling portion 211 bearing a label (not shown) thereon and a fixing portion 213 for fixing the cover 23 and the locking member 24. The fixing portion 213 defines a mounting hole 2131 for receiving the locking member 24. The mounting hole 2131 includes a sliding portion 2133 away from the latching strip 25 and a mounting portion 2135 adjacent to the latching strip 25.

The cover 23 is substantially rectangular and receives the locking member 24. The cover 23 includes two sidewalls 231 opposite to each other, a rear wall 233 and a top plate 235. The two sidewalls 231 and the rear wall 233 all extend from the fixing portion 213. The rear wall 233 interconnects the two sidewalls 231. The top plate 235 is connected to the two sidewalls 231 and the rear wall 233. The top plate 235 and the two sidewalls 231 cooperatively define an opening (not labeled), in which the locking member 24 is mounted. Each sidewall 231 forms two positioning ribs 2311 spaced from each other. The cover 23 defines a circular covering hole 2351 between two slits 2353 on the top plate 235.

The cover 23 is fixed at a surface of the fixing portion 213, covering the mounting portion 2135 of the mounting hole 2131, and the sliding portion 2133 is exposed out of the cover. The opening of the cover 23 faces the sliding portion 2133. In the illustrated embodiment, the cover 23 is integrally formed with the fixing portion 213, or, alternatively, may be fixed on the fixing portion 213 by glue.

Figure 3:
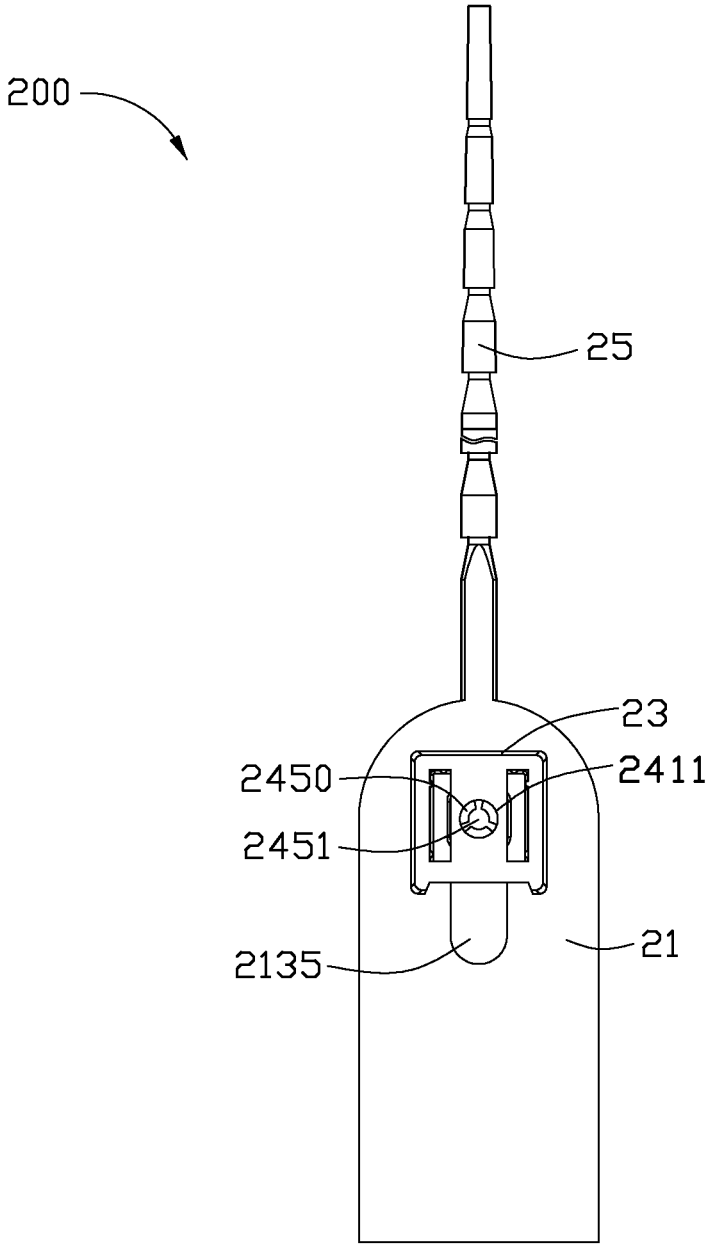
FIG. 3 is a top view of the plastic sealing fastener of FIG. 1, with the locking member fixed on the fixing member.

Also referring to FIG. 3, the locking member 24 includes a rectangular main body 241, a receiving portion 243 positioned at a surface of the main body 241 and a locking portion 245 received in the receiving portion 243. The main body 241 defines a rectangular locking slot 2411 at a surface thereof away from the receiving portion 243, that is larger than the covering hole 2351. The locking portion 245 includes three elastic locking teeth 2450 formed on a side surface of the locking slot 2411, cooperatively defining a through hole 2451 therebetween, that is smaller than the covering hole 2351. The locking teeth 2450 are elastically deformable, thereby allowing the latching strip 25 to pass therethrough to lock in the through hole 2451. The main body 241 defines a plurality of positioning slots 2413 corresponding to the positioning ribs 2311, for fixing the locking member 24.

The latching strip 25 extends from an end of the fixing portion 213 away from the labeling portion 21, and forming a plurality of latching portions 251. The latching portions 251 are arranged end to end. Each latching portion 251 includes a cylindrical portion 2511 adjacent to the fixing member 21 and a tapered portion 2513 away from the fixing member 21. Each cylindrical portion 2511 forms a locking surface 2515 away from the tapered portion 2513 correspondingly.

In use, the locking member 24 is positioned on the fixing portion 213, and the receiving portion 243 of the locking member 24 is positioned in the sliding portion 2133 of the mounting hole 2131. The locking member 24 is received in the cover 23, and the receiving portion 243 slides in the mounting portion 2135 of the mounting hole 2131. The positioning slot 2413 of the locking member 24 engageably receives the positioning rib 2311 of the cover 23 to fix the locking member 24 in the cover 23. The covering hole 2351 of the cover 23 faces the through hole 2451 of the locking member 24. Since the covering hole 2351 is smaller than the locking slot 2411, the locking slot 2411 is partially covered thereby. The latching strip 25 passes through an object to be secured, and the latching strip 25 is bent towards the fixing member 21 and passes through the locking member 24 from the receiving portion 243. The tapered portion 2513 of the latching strip 25 resists and deforms the three locking teeth 2450. When recovered, the locking teeth 2450 latches the locking surface 2515, to fix the latching strip 25 in the through hole 2451. The through hole 2451 is at least partially covered by the cover 23 whereby the plastic sealing fastener 200 cannot be unlocked using simple tools such as metal strips, suffering irreparable. Therefore, the plastic sealing fastener 200 must then be damaged to be forced open.

The plastic sealing fastener 200 can be used in customs, for sealing objects to be imported and exported, and to secure goods. When a plurality of plastic sealing fasteners 200 is employed for an equal number of objects, each plastic sealing fastener 200 can be labeled at the labeling portion 211 with a unique number for identification, to further improve security.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A plastic sealing fastener comprising:

a fixing member;

a locking member comprising a receiving portion and defining a locking slot at a surface of the locking member away from the receiving portion;

a latching strip formed on the fixing member; and a cover fixed on the fixing member, wherein the locking member forms a locking portion in the locking slot; the cover defines a covering hole communicating with the locking slot, and a size of the covering hole is less than that of the locking slot; the locking portion is comprised of a plurality of locking teeth, the fixing member defines a mounting hole therein, the mounting hole comprises a mounting portion and a sliding portion communicating with the mounting portion, the sliding portion is exposed out of the cover, in an unlocked state, the receiving portion of the locking member is slidably received in the sliding portion of the mounting hole; in a locked state, the receiving portion slides in and passes through the mounting portion of the mounting hole, the latching strip passes through the mounting portion of the mounting hole and the receiving portion of the locking member.

2. The plastic sealing fastener of claim 1, wherein the locking member defines at least one positioning slot, and the cover forms at least one positioning rib engaging with the positioning slot to fix the locking member in the cover.

3. The plastic sealing fastener of claim 2, wherein the cover comprises two sidewalls opposite to each other and a top plate on the two sidewalls, the covering hole is defined on the top plate, and the positioning rib is formed on the sidewall.

4. The plastic sealing fastener of claim 3, wherein the cover defines two slits on the top plate, and the covering hole is between the two slits.

5. The plastic sealing fastener of claim 1, wherein the fixing member comprises a fixing portion and a labeling portion, the mounting hole is defined in the fixing portion, and the labeling portion is configured for supporting a label.

6. The plastic sealing fastener of claim 1, wherein the locking portion comprises of three locking teeth.

* * * * *